US012409987B2

(12) United States Patent
Kim et al.

(10) Patent No.: US 12,409,987 B2
(45) Date of Patent: Sep. 9, 2025

(54) AUTOMATICALLY-CHARGEABLE SPOUT TYPE COSMETICS CONTAINER

(71) Applicant: APOLLO INDUSTRIAL CO., LTD., Siheung-si (KR)

(72) Inventors: Kyung Sook Kim, Anyang-si (KR); Seung Min Lee, Busan (KR); Dae Sik Seo, Anyang-si (KR)

(73) Assignee: APOLLO INDUSTRIAL CO., LTD., Siheung-si (KR)

( * ) Notice: Subject to any disclaimer, the term of this patent is extended or adjusted under 35 U.S.C. 154(b) by 273 days.

(21) Appl. No.: 18/363,885

(22) Filed: Aug. 2, 2023

(65) Prior Publication Data

US 2023/0373694 A1 Nov. 23, 2023

Related U.S. Application Data

(63) Continuation of application No. PCT/KR2022/013930, filed on Sep. 19, 2022.

(30) Foreign Application Priority Data

Sep. 29, 2021 (KR) ..... 10-2021-0128543

(51) Int. Cl.

| | |
|---|---|
| ***B65D 47/18*** | (2006.01) |
| ***A45D 34/00*** | (2006.01) |
| ***A45D 34/04*** | (2006.01) |

(52) U.S. Cl.

CPC ..... *B65D 47/18* (2013.01); *A45D 34/04* (2013.01); *A45D 2034/002* (2013.01); *A45D 2200/054* (2013.01)

(58) Field of Classification Search

CPC .. B65D 47/18; A45D 34/04; A45D 2034/002; A45D 2200/054

(Continued)

(56) References Cited

U.S. PATENT DOCUMENTS 8,403,008 B2 * 3/2013 Bouix ..... G01F 11/025 141/23
11,957,230 B2 * 4/2024 Bianco ..... A45D 34/041

(Continued)

FOREIGN PATENT DOCUMENTS

KR 20110120099 A 11/2011
KR 200463135 Y1 10/2012

(Continued)

*Primary Examiner* — Paul R Durand
*Assistant Examiner* — Michael J. Melaragno
(74) *Attorney, Agent, or Firm* — NKL Law; Jae Youn Kim

(57) ABSTRACT

The present invention relates to an automatically-chargeable spout type cosmetics container. The automatically-chargeable spout type cosmetics container allows air present in a pusher to be introduced into a spout tube or allows ambient air to be introduced into the pusher, but prevents a cosmetics liquid from being introduced into the pusher, by a valve installed at the spout tube, thereby preventing deformation and hardening of the pusher. The automatically-chargeable spout type cosmetics container automatically charges the cosmetics liquid in an interior of the spout tube such that the height of the cosmetics liquid charged in the interior of the spout tube becomes equal to the height of the cosmetics liquid contained in a container body through a configuration in which a communication hole formed at an outer peripheral surface of a connecting tube achieves communication between the interior of the spout tube and the container body.

10 Claims, 16 Drawing Sheets

(58) Field of Classification Search
USPC ..... 222/251
See application file for complete search history.

(56) References Cited

U.S. PATENT DOCUMENTS

| | | | | |
|---|---|---|---|---|
| 2022/0087396 | A1* | 3/2022 | Bianco | A45D 34/04 |
| 2024/0245194 | A1* | 7/2024 | Bianco | A45D 34/04 |

FOREIGN PATENT DOCUMENTS

| | | | |
|---|---|---|---|
| KR | 101339855 | B1 | 12/2013 |
| KR | 101572007 | B1 | 11/2015 |
| KR | 2020160001585 | U | 5/2016 |
| KR | 101780903 | B1 | 9/2017 |

* cited by examiner

AUTOMATICALLY-CHARGEABLE SPOUT TYPE COSMETICS CONTAINER

TECHNICAL FIELD

The present invention relates to an automatically-chargeable spout type cosmetics container, and more particularly to an automatically-chargeable spout type cosmetics container capable of not only preventing a cosmetics liquid charged in a spout tube from being introduced (backward flow) into a pusher, to prevent the cosmetics liquid from contacting the pusher, which is made of a rubber material, thereby effectively preventing deformation and hardening of the pusher, but also automatically charging the cosmetics liquid in an interior of the spout tube such that the height of the cosmetics liquid charged in the interior of the spout tube becomes equal to the height of the cosmetics liquid contained in a container body, when the spout tube is inserted into the container body.

BACKGROUND ART

In general, in highly cosmeceutical essence cosmetics such as anti-aging cosmetics or anti-wrinkle cosmetics, a cosmetics liquid (cosmetics contents) thereof is very weak against contamination because the highly cosmeceutical essence cosmetics do not contain a preservative. For this reason, when the contents of such highly cosmeceutical essence cosmetics are used in such a manner that the user dips their hand into the cosmetics contents, as in general cream type cosmetics, or in such a manner that the user discharges the cosmetics contents by bringing the palm into contact with an opening of a cosmetics container, as in a lotion, contaminants staining the hand may penetrate an interior of the cosmetics container and, as such, there may be a possibility that the cosmetics liquid deteriorates.

In addition, when highly cosmeceutical cosmetics are used, it is preferred that a cosmetics liquid be used in a dose. When an excessive or insufficient amount of the cosmetics liquid is used, an adverse reaction on the skin may be produced, or no effect may be produced. For this reason, a cosmetics container capable of discharging a cosmetics liquid in a dose is needed.

Furthermore, since highly cosmeceutical cosmetics are expensive, it is economical that a cosmetics liquid be correctly supplied to an area to which the cosmetics liquid is to be applied, for use thereof. When the cosmetic liquid is dispensed onto the palm of the hand, for use thereof, as in conventional cases, the amount of the cosmetic liquid absorbed by the palm becomes large and, as such, there is a problem of waste of the expensive cosmetics liquid.

In order to solve the above-mentioned problems, a spout type container is disclosed in Korean Unexamined Patent Publication No. 10-2011-0120099, and an automatically-chargeable spout type cosmetics container is disclosed in Korean Registered Patent No. 10-1572007.

The conventional spout type container is configured through inclusion of a container body configured to receive contents therein, a plug coupled to an inlet of the container body, a spout assembly coupled to the plug and provided with a spout configured to be lengthened when the plug is separated from the container body.

On the other hand, the conventional automatically-chargeable spout type cosmetics container is configured to suck a cosmetics liquid (cosmetics contents) by a spout, and then to coat a cosmetics liquid on a skin portion to be applied with the cosmetic liquid.

In the conventional automatically-chargeable spout type cosmetics container, when an opening of the cosmetics container and female threads of a thread coupling member are threadedly coupled to each other, an upper inner-peripheral engagement jaw of an outer cylindrical member is engaged with an outer-peripheral engagement jaw of a retractable push button, thereby causing a cylindrical spring to be compressed and, at the same time, causing a piston in a circular cylinder to be lowered. In addition, a closing protrusion disposed in a lower hole is lowered and, as such, communication between an air groove of the closing protrusion and an inner peripheral surface of the lower hole is achieved. Accordingly, air in a lower space of the piston, which has a circular ring shape, is urged toward a lower portion of a spout tube, and the lower hole is closed by an upper end surface of the closing protrusion, that is, an upper portion of the air groove.

When the threaded coupling is released through rotation of the cylindrical outer member in order to extract the spout tube in the above-mentioned state, the cylindrical spring is elastically restored and, as such, the retractable push button is upwardly pushed and, at the same time, the circular ring-shaped piston is moved upwards in the circular cylinder. At the same time, the closing protrusion of the cylindrical member is moved upwards along the inner peripheral surface of the lower hole. As a result, air in the spout tube is sucked into a lower space of the circular ring-shaped piston, thereby causing a cosmetics liquid in the cosmetics container to be sucked into the spout tube to a level corresponding to a predetermined portion of the spout tube from a lower end of the spout tube.

When the user pushes the retractable push button in the above-mentioned state under the condition that the user grips the cylindrical outer member by the palm, the circular ring-shaped piston is lowered and, as such, the closing protrusion protruding toward a lower portion of the lower hole of the circular cylinder is lowered, thereby discharging the cosmetics liquid through the spout tube.

However, the conventional automatically-chargeable spout type cosmetics container has the following problems.

First, the conventional automatically-chargeable spout type cosmetics container is configured to have a complicated structure in which, when the opening of the cosmetics container and the female threads of the thread coupling member are threadedly coupled to each other, the upper inner-peripheral engagement jaw of the outer cylindrical member is engaged with the outer-peripheral engagement jaw of the retractable push button, thereby causing the cylindrical spring to be compressed and, at the same time, causing the piston in the circular cylinder to be lowered, in addition, the closing protrusion disposed in the lower hole is lowered and, as such, communication between the air groove of the closing protrusion and the inner peripheral surface of the lower hole is achieved to achieve automatic charging. For this reason, operation is ineffective, and assemblability and productivity are considerably degraded, thereby resulting in an increase in manufacturing costs.

Second, when the retractable push button moves upwards and downwards, the cosmetics liquid (cosmetics contents) may be introduced into the retractable push button in a procedure of sucking the cosmetics liquid and, as such, may be contaminated. As a result, waste of the expensive cosmetics liquid may occur. In particular, when the push button of the conventional spout type cosmetics container is made of a rubber material, deformation or hardening of the push button may occur. In this case, there may be a problem of degradation of the function of the push button.

Third, the bottom surface of the cosmetics container protrudes upwards at a central portion thereof due to characteristics of container manufacture using blow molding, and is manufactured to be spaced apart from a lower end of the spout tube by 3 mm or more, taking tolerances into consideration, in order to prevent the lower end of the spout tube from contacting the bottom surface of the cosmetics container. For this reason, even when the cosmetics container is completely used, the cosmetics liquid still remains in a considerable amount and, as such, this is uneconomical. Furthermore, when the residual cosmetics liquid is disposed of without any treatment, there may be a problem of environmental pollution.

DISCLOSURE

Technical Problem

Therefore, the present invention has been made in view of the above problems, and it is an object of the present invention to provide an automatically-chargeable spout type cosmetics container capable of not only allowing air present in a pusher to be introduced into a spout tube or allowing ambient air to be introduced into the pusher, but preventing a cosmetics liquid from being introduced (backward flow) into the pusher, by a valve installed at the spout tube, to prevent the cosmetics liquid from contacting the pusher, which is made of a rubber material, thereby effectively preventing deformation and hardening of the pusher, but also automatically charging the cosmetics liquid in an interior of the spout tube such that the height of the cosmetics liquid charged in the interior of the spout tube becomes equal to the height of the cosmetics liquid contained in a container body, when the spout tube is inserted into the container body, through a configuration in which a communication hole formed at an outer peripheral surface of a connecting tube achieves communication between the interior of the spout tube and the container body.

Objects of the present invention are not limited to the above-described objects, and other objects of the present invention not yet described will be more clearly understood by those skilled in the art from the following detailed description.

Technical Solution

In accordance with an aspect of the present invention, the above and other objects can be accomplished by the provision of an automatically-chargeable spout type cosmetics container including a container body configured to receive a cosmetics liquid therein and formed with an opening at an upper portion thereof, a spout tube installed to be inserted into the container body through the opening, the spout tube being formed, at a lower end thereof, with a cosmetics liquid hole, to suck and discharge the cosmetics liquid of the container body, a connecting tube provided at an upper portion of the spout tube, the connecting tube being provided, at an outer peripheral surface thereof, with a communication hole communicating with the container body, to automatically charge the cosmetics liquid in an interior of the spout tube to a level equal to a level of the cosmetics liquid received in the container body, a communication hole opening/closing ring elastically installed at the outer peripheral surface of the connecting tube such that the communication hole opening/closing ring is vertically movable, to selectively open or close the communication hole when the spout tube is inserted into the container body or is extracted from the container body, a pusher fixedly installed at an upper portion of the connecting tube and configured to provide air to the interior of the spout tube, to discharge the cosmetics liquid charged in the spout tube, a valve installed at the upper portion of the connecting tube, to allow air in the pusher to be introduced into the spout tube while preventing the cosmetics liquid in the spout tube from being introduced into the pusher when the pusher is pressed, a cap fixedly installed at a lower portion of the pusher and fastened to the opening, to be opened and closed, and a wiper installed at an inner periphery of the opening to wipe a cosmetics liquid attached to an outer periphery surface of the spout tube, the wiper including a spacer formed at an inner peripheral surface of the wiper and configured to maintain opening of the communication hole when the cap is closed to insert the spout tube, a first stopper formed at a lower portion of an upper end of the spacer and configured to prevent downward movement of the communication hole opening/closing ring when the spout tube is inserted, thereby causing the communication hole opening/closing ring to open the communication hole, and a second stopper formed at an upper portion of the upper end of the spacer and configured to prevent upward movement of the communication hole opening/closing ring when the spout tube is extracted, thereby causing the communication hole opening/closing ring to close the communication hole.

When the spout tube is inserted, the first stopper may prevent downward movement of the communication opening/closing ring, thereby causing the communication hole opening/closing ring to open the communication hole such that the cosmetics liquid is automatically charged in the interior of the spout tube to a level equal to a level of the cosmetics liquid received in the container body. When the spout tube is extracted, the second stopper may prevent upward movement of the communication hole opening/closing ring, thereby causing the communication hole opening/closing ring to close the communication hole such that, when the pusher is pressed to discharge the cosmetics liquid charged in the spout tube, air present in the pusher is supplied to the interior of the spout tube, to enable the cosmetics liquid of the spout tube to be discharged.

A first step may be formed at an upper end of the spout tube, to set a position of the communication hole opening/closing ring after the communication hole opening/closing ring closes the communication hole as the second stopper prevents upward movement of the communication opening/closing ring when the spout tube is extracted, and inclined surfaces are formed at an outer peripheral surface of the communication hole opening/closing ring and an inner peripheral surface of the second stopper, respectively, to enable the communication hole opening/closing ring to be separated from the second stopper after a position of the communication hole opening/closing ring is set by the first step.

A second step may be formed at an upper end of the connecting tube, to set a position of the communication hole opening/closing ring after the communication hole opening/closing ring opens the communication hole as the first stopper prevents downward movement of the communication opening/closing ring when the spout tube is inserted The communication hole opening/closing ring may include a body disposed between the first stopper and the second stopper when the spout tube is inserted, an upper wing formed at an upper portion of the body, to extend upwards, the upper wing being brought into contact with the second step when the spout tube is inserted, and a lower wing formed at a lower portion of the body, to extend downwards, the lower wing being brought into contact with the first step when the spout tube is extracted.

The spacer may be formed in a number of at least two at the inner peripheral surface of the wiper such that the at least two spacers are spaced apart from one another by a predetermined distance, and a guide may be inclinedly formed at the upper end of the spacer, to guide downward movement of the communication hole opening/closing ring when the spout tube is inserted.

The container body may be provided with a bottom plate at a lower end thereof. A cosmetics liquid residual collection groove may be formed at a central portion of an upper surface of the bottom plate. The upper surface of the bottom plate may be formed to be inclined toward the cosmetics liquid residual collection groove. The lower end of the spout tube may be inserted into the cosmetics liquid residual collection groove.

The bottom plate may be manufactured as a part separate from the container body.

The bottom plate may be manufactured in an insert injection molding manner.

The wiper may be formed, at the inner peripheral surface thereof, with a spacer configured to maintain opening of the communication hole when the cap is closed to insert the spout tube. A first stopper may be formed at the lower portion of the upper end of the spacer and may be configured to prevent downward movement of the communication hole opening/closing ring when the spout tube is inserted, thereby causing the communication hole opening/closing ring to open the communication hole. A second stopper may be formed at the upper portion of the upper end of the spacer and may be configured to prevent upward movement of the communication hole opening/closing ring when the spout tube is extracted, thereby causing the communication hole opening/closing ring to close the communication hole.

Advantageous Effects

The automatically-chargeable spout type cosmetics container according to the present invention having the above-described configurations has the following effects.

First, when a cosmetics liquid flow or an air flow is generated in accordance with a pressure difference generated during depression or restoration of the pusher, air present in the pusher is allowed to be introduced into the spout tube or ambient air is allowed to be introduced into the pusher by the valve, whereas it may be possible to effectively prevent the cosmetics liquid of the spout tube from being introduced into the pusher by the valve.

Second, a gap is formed between the outer peripheral surface of the connecting tube and the inner peripheral surface of the wiper by the spacer formed at the inner peripheral surface of the wiper and, as such, the communication hole formed at the outer peripheral surface of the connecting tube causes the interior of the spout tube to communicate with the container body. Accordingly, the cosmetics liquid may be automatically charged in the interior of the spout tube to a level equal to the level of the cosmetics liquid received in the container body.

Third, the communication hole opening/closing ring is elastically installed at the outer peripheral surface of the connecting tube such that the communication hole opening/closing ring is vertically movable, in order to selectively open or close the communication hole when the spout tube is inserted into the container body or is extracted from the container body. Accordingly, when the spout tube is extracted, the second stopper prevents upward movement of the communication opening/closing ring, thereby causing the communication hole opening/closing ring to close the communication hole. On the other hand, when the spout tube is inserted, the first stopper prevents downward movement of the communication opening/closing ring, thereby causing the communication hole opening/closing ring to open the communication hole. Thus, automatic charging and discharge of the cosmetics liquid may be easily achieved and, as such, there is an advantage of convenience in use.

Fourth, assemblability may be enhanced, and production costs may be reduced in that the overall configuration is simple, and automatic charging and discharge of the cosmetics liquid are easily achieved.

Fifth, the bottom plate is formed at the bottom of the container body in an insert molding manner, the cosmetics liquid residual collection groove is formed at the central portion of the upper surface of the bottom plate, and the upper surface of the bottom plate is configured to have an inclined structure. Accordingly, a residual cosmetics liquid is collected in the cosmetics liquid residual collection groove and, as such, the amount of the cosmetics liquid remaining in the container body may be minimized by virtue of the nozzle inserted into the cosmetics liquid residual collection groove.

The effects of the present invention are not limited to the above-described effects, and other effects not described herein may be derived by those skilled in the art from the following description of the claims.

DESCRIPTION OF DRAWINGS

FIG. 8 shows a state in which, when the spout tube is moved upwards after opening of a cap, a communication hole opening/closing ring closes a communication hole, a second stopper holds a body of the communication hole opening/closing ring, and, at the same time, a lower wing of the communication hole opening/closing ring is engaged with a second step.

FIG. 9 shows a state in which, when the spout tube is further moved upwards after opening of the cap, the body of the communication hole opening/closing ring is separated from the second stopper.

FIG. 10 shows a completely extracted state of the spout tube according to the embodiment of the present invention.

Description of Reference Numerals to Drawings

Figure 1:
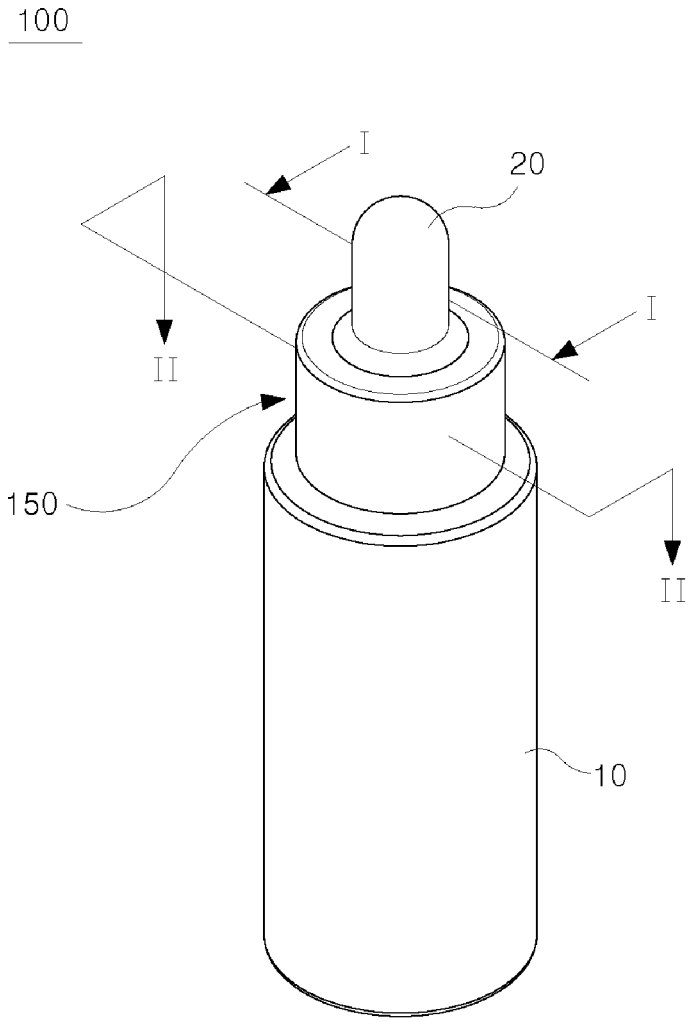
FIG. 1 is a perspective view of an automatically-chargeable spout type cosmetics container according to an embodiment of the present invention, showing an inserted state of a spout tube.

10: container body
11: opening
11a: male threads
12: bottom plate
12a: cosmetics liquid residual collection groove
20: pusher
100: automatically-chargeable spout type cosmetics container
110: spout
111: body
112: coupling
113: nozzle
114: cosmetics liquid hole
120: connecting tube
121: communication hole
123: upper jaw
130: communication hole opening/closing ring
131: body
132: upper wing
133: lower wing
140: valve
141: flange
142: flexible membrane
143: slit
150: cap
151: inner cap
151a: female threads
152: outer cap
160: wiper
161: wiping portion
162: seating flange
163: spacer
163a: guide
164: first stopper
165: second stopper
166: first step
167: second step

BEST MODE

Hereinafter, preferred embodiments of the present invention will be described in detail with reference to the accompanying drawings such that those skilled in the art may easily implement the present invention. In describing the preferred embodiments, description of technical contents which are well known in the technical field to which the present invention pertains and are not directly related to the present invention will be omitted. This is to more clearly communicate the present invention without obscuring the subject matter of the present invention by omitting an unnecessary description. For the same reason, in the accompanying drawings, some components are exaggerated, omitted or schematically illustrated. In addition, the size of each component does not fully reflect the actual size thereof. The same or corresponding components in each drawing are given the same reference numerals. In addition, it will be appreciated that expressions and predicates used herein with respect to terms associated with device or element orientation (e.g., "front", "back", "up", "down", "top", "bottom", "left", "right", "lateral", etc.) are used merely to simplify the description of the present invention, and do not represent or mean that devices or elements associated therewith should have particular orientations.

Hereinafter, an automatically-chargeable spout type cosmetics container according to an embodiment of the present invention will be described with reference to the accompanying drawings.

First, the accompanying drawings will be briefly described.

Figure 2:
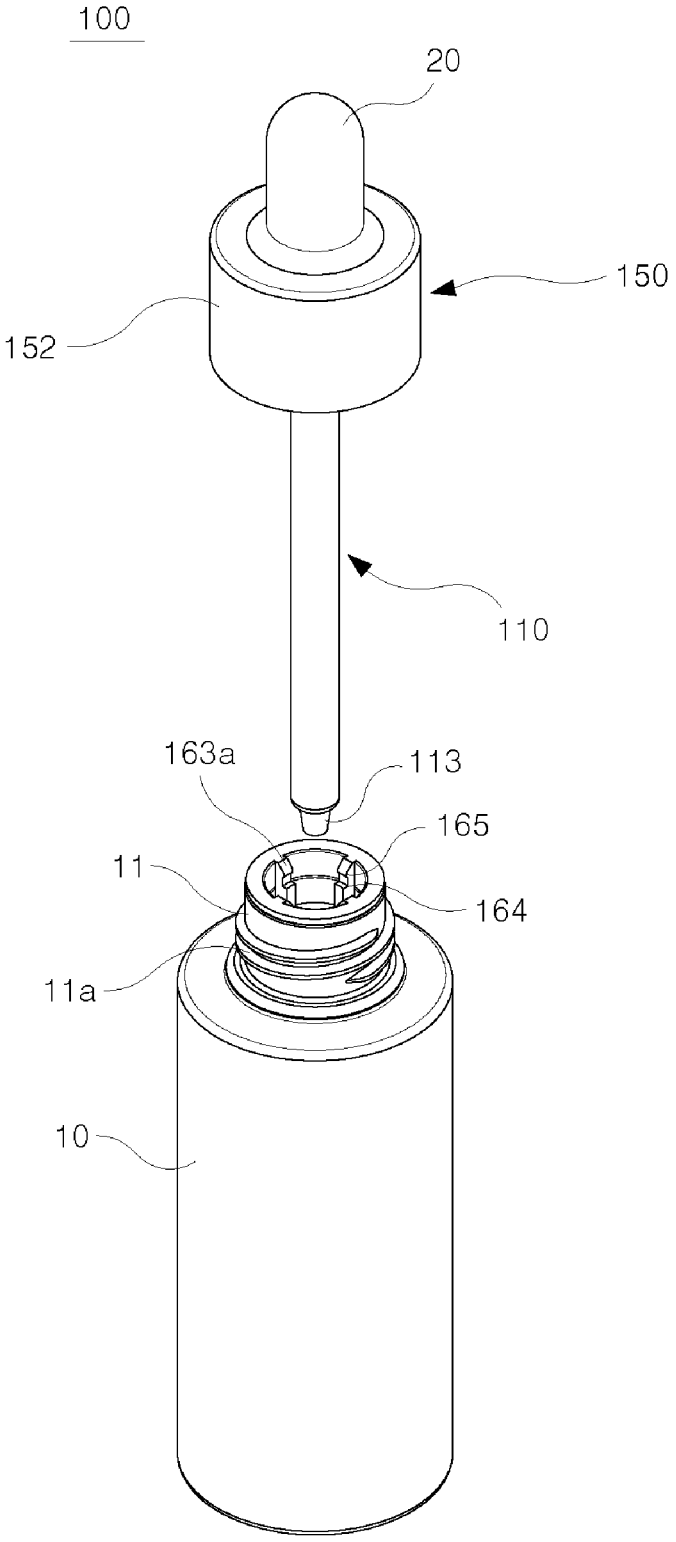
FIG. 2 is a perspective view of the automatically-chargeable spout type cosmetics container according to the embodiment of the present invention, showing an extracted state of the spout tube.

FIG. 1 is a view showing an inserted state of a spout tube in the automatically-chargeable spout type cosmetics container according to the embodiment of the present invention. FIG. 2 is a view showing an extracted state of the spout tube in the automatically-chargeable spout type cosmetics container according to the embodiment of the present invention.

Figure 3:
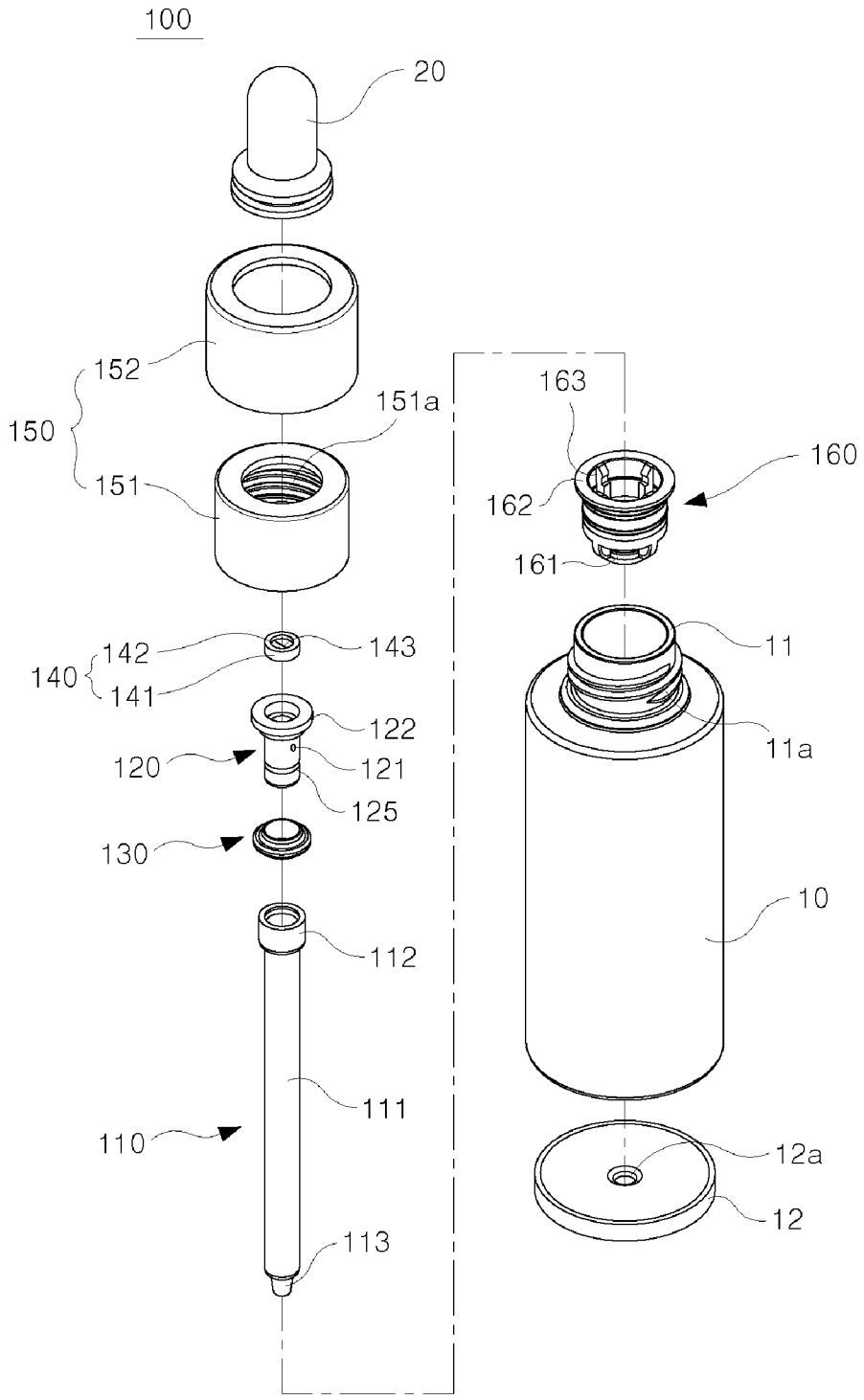
FIG. 3 is an exploded perspective top view showing the whole structure of the automatically-chargeable spout type cosmetics container according to the embodiment of the present invention.
Figure 4:
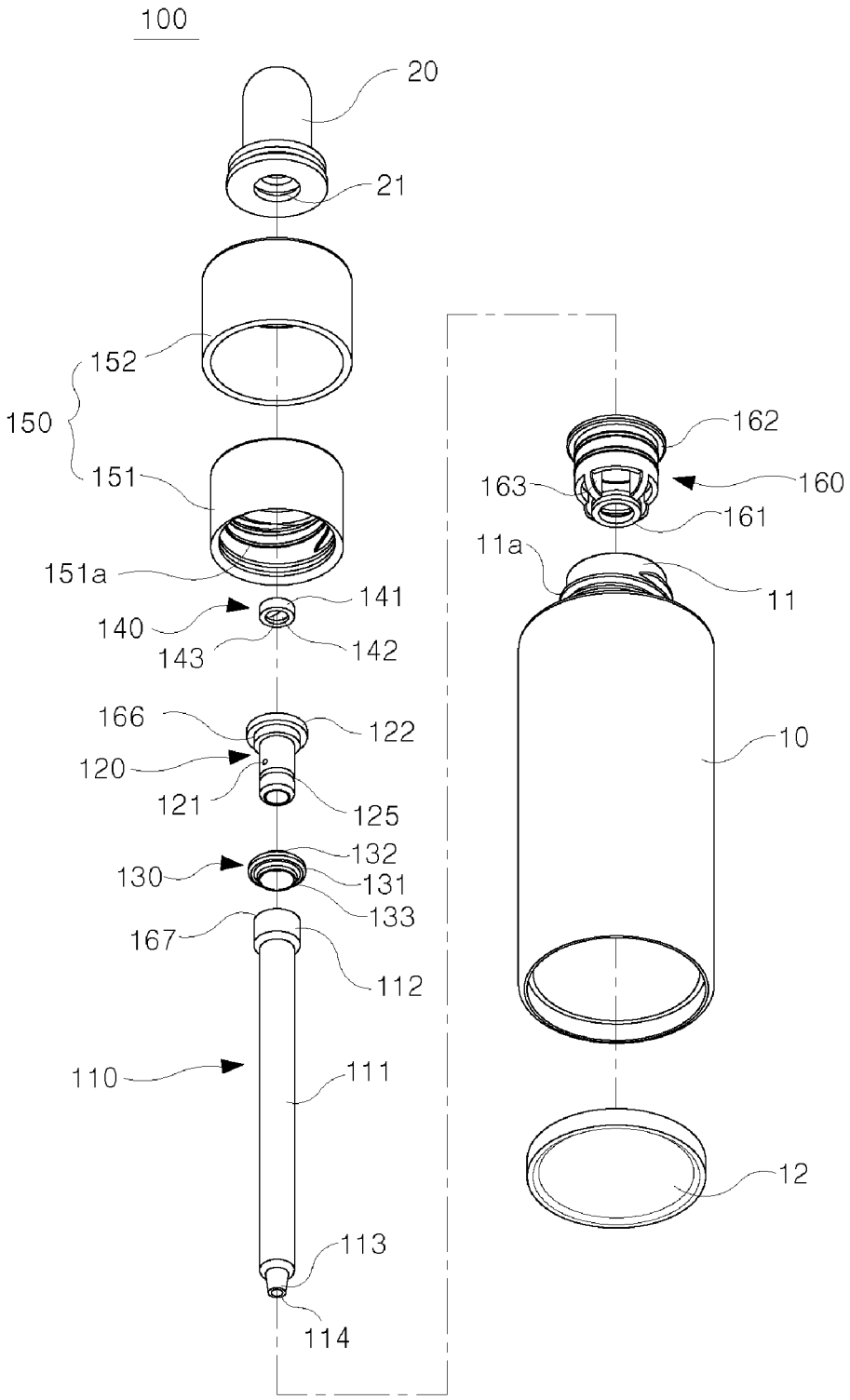
FIG. 4 is an exploded perspective bottom view showing the whole structure of the automatically-chargeable spout type cosmetics container according to the embodiment of the present invention.

FIG. 3 is an exploded perspective top view showing the whole structure of the automatically-chargeable spout type cosmetics container according to the embodiment of the present invention. FIG. 4 is an exploded perspective bottom view showing the whole structure of the automatically-chargeable spout type cosmetics container according to the embodiment of the present invention.

Figure 5:
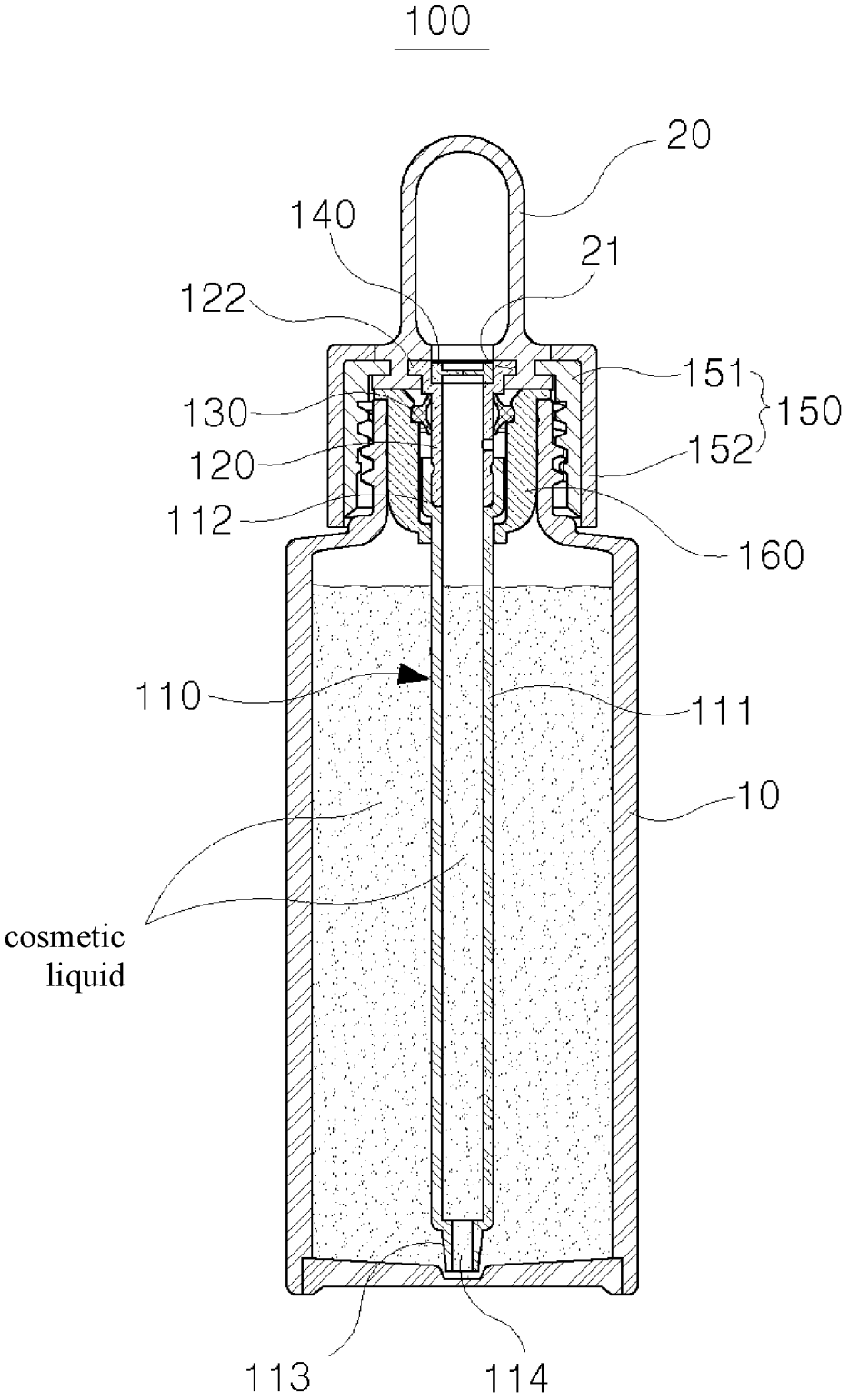
FIG. 5 is a cross-sectional view taken along line I-I in FIG. 1.
Figure 6:
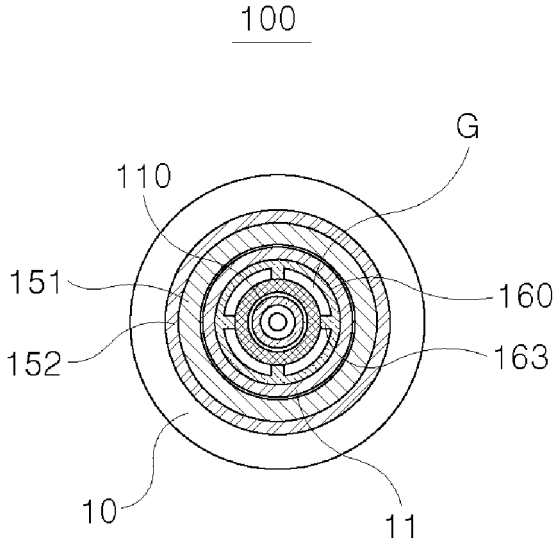
FIG. 6 is a cross-sectional view taken along line II-II in FIG. 1.
Figure 7:
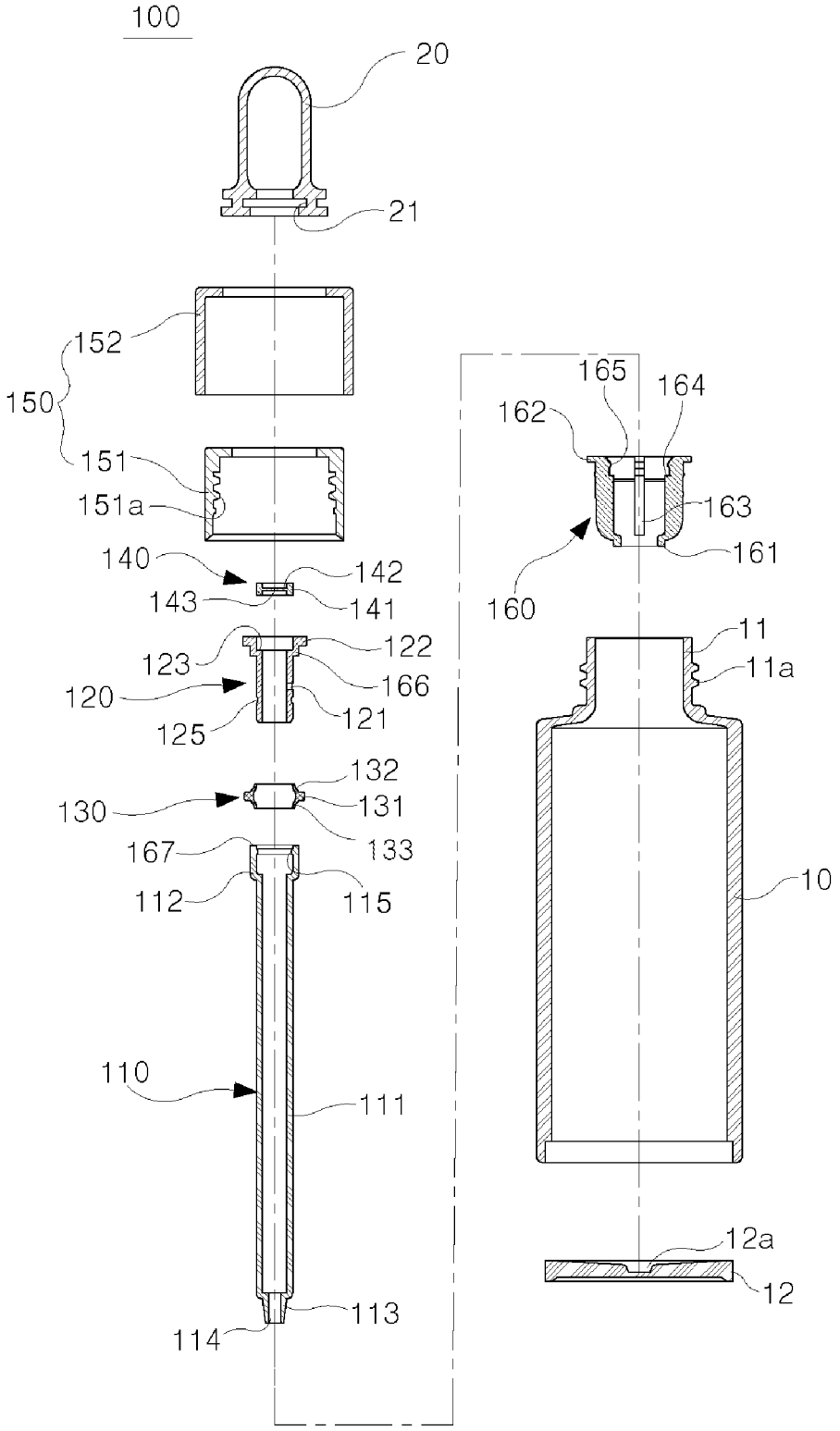
FIG. 7 is an exploded cross-sectional view corresponding to FIG. 5.

FIG. 5 is a cross-sectional view taken along line I-I in FIG. 1. FIG. 6 is a cross-sectional view taken along line II-II in FIG. 1. FIG. 7 is an exploded cross-sectional view corresponding to FIG. 5.

Figure 8:
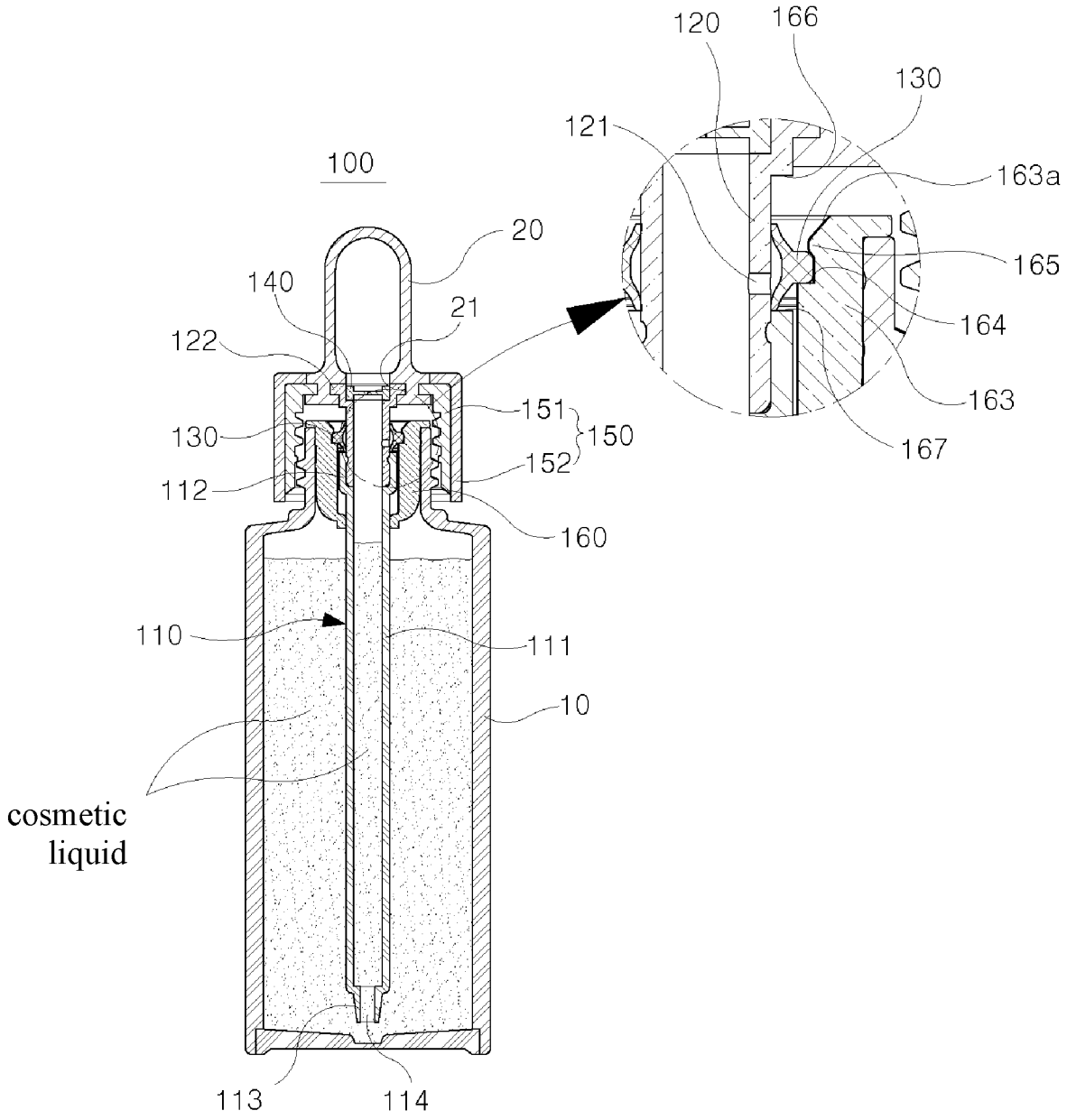
FIGS. 8 to 10 are cross-sectional views explaining a procedure of extracting the spout in the automatically-chargeable spout type cosmetics container according to the embodiment of the present invention.
Figure 9:
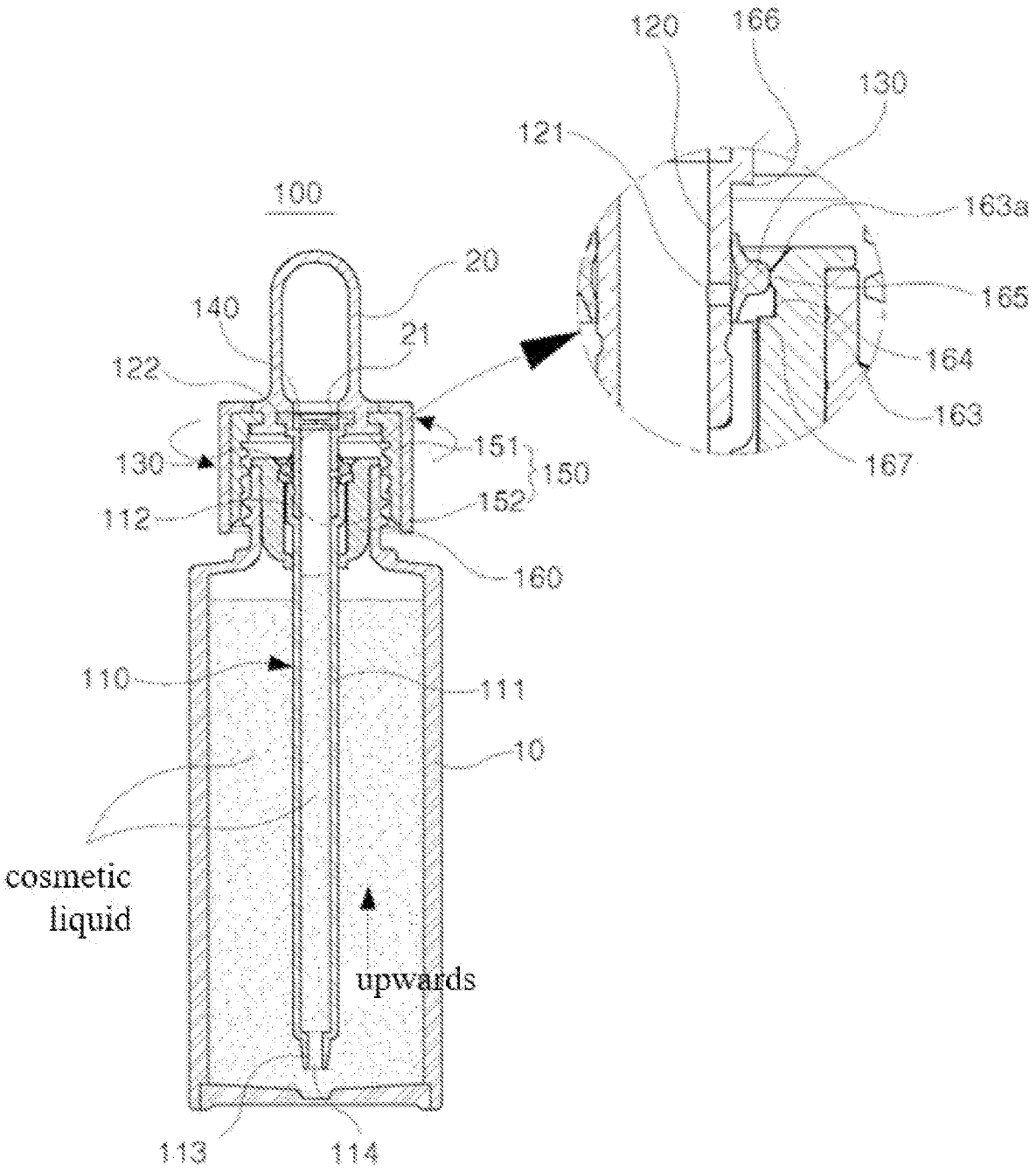
Figure 10:
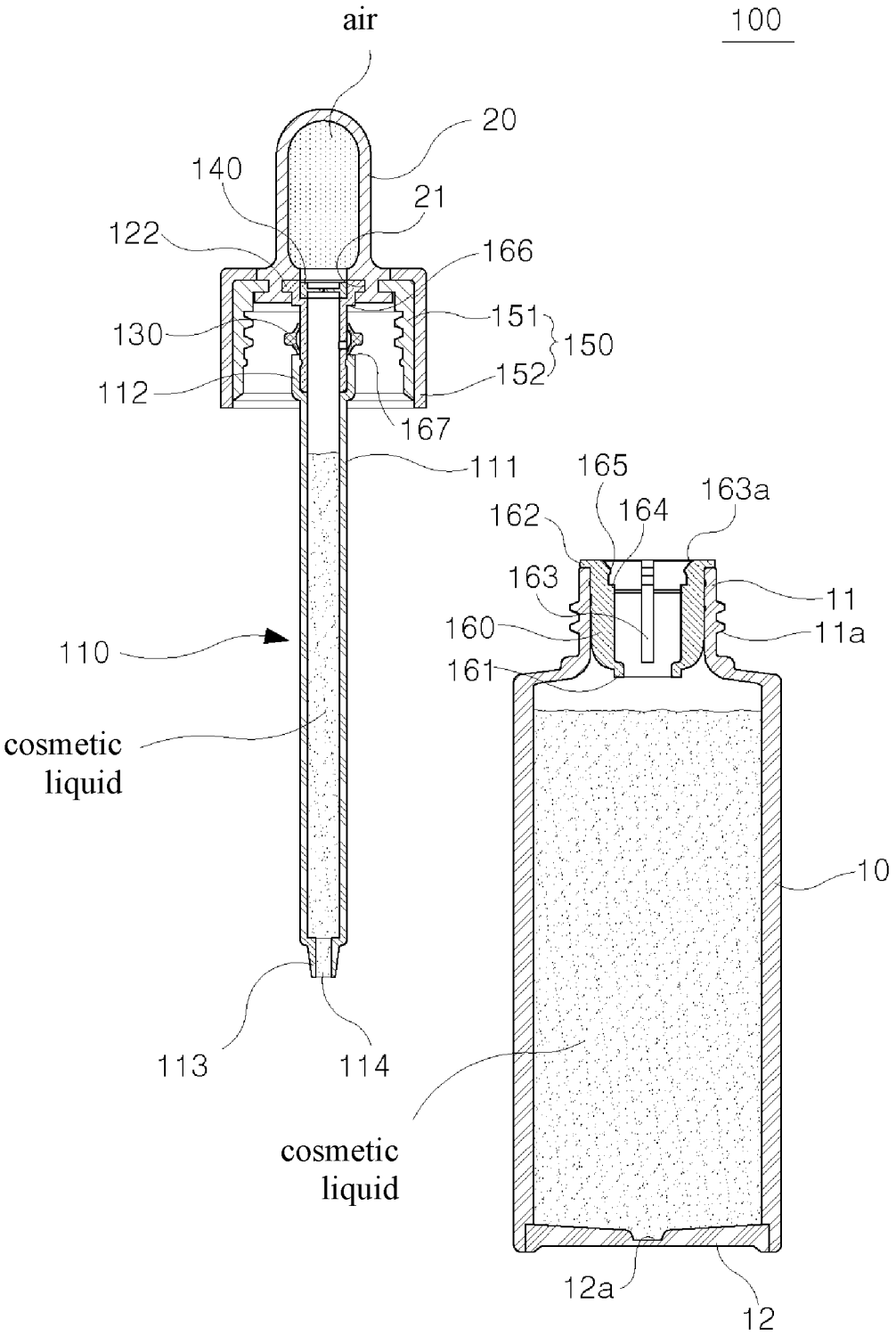

FIGS. 8 to 10 show a procedure of extracting the spout tube in the automatically-chargeable spout type cosmetics container according to the embodiment of the present invention.

In detail, FIG. 8 shows a state in which, when the spout tube is moved upwards after opening of a cap, a communication hole opening/closing ring closes a communication hole, a second stopper holds a body of the communication hole opening/closing ring, and, at the same time, a lower wing of the communication hole opening/closing ring is engaged with a second step.

FIG. 9 shows a state in which, when the spout tube is further moved upwards after opening of the cap, the body of the communication hole opening/closing ring is separated from the second stopper. FIG. 9 shows that, since the communication hole opening/closing ring is made of a soft material such as rubber or the like, the body of the communication hole opening/closing ring elastically contacts the second stopper by an upper wing and the lower wing.

Figure 11:
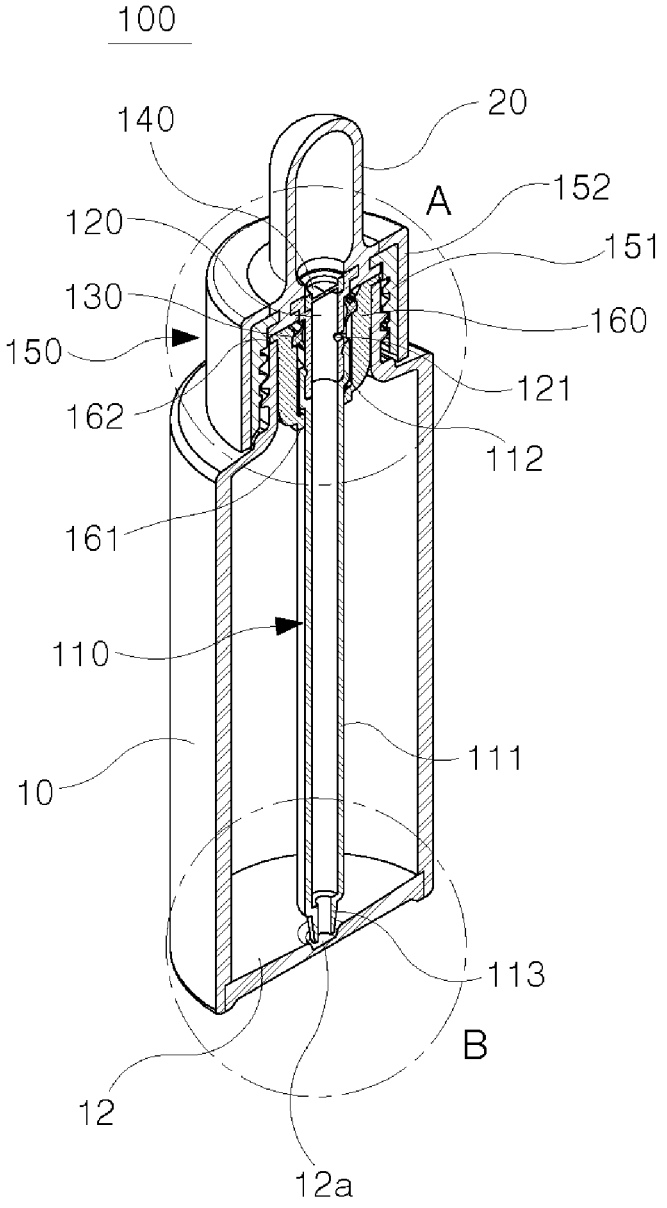
FIG. 11 is a broken perspective view corresponding to FIG. 1.
Figure 12:
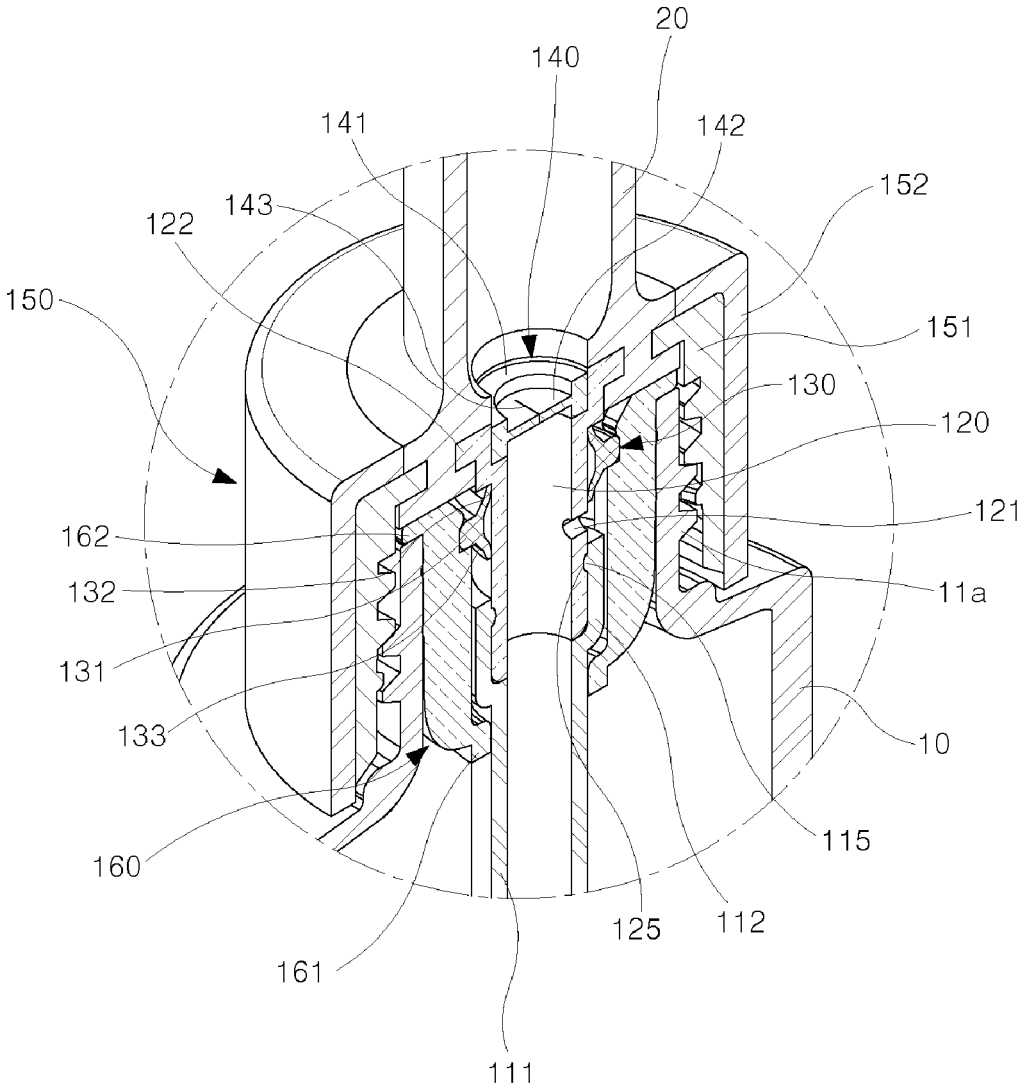
FIG. 12 shows an enlarged state of a portion A in FIG. 11.
Figure 13:
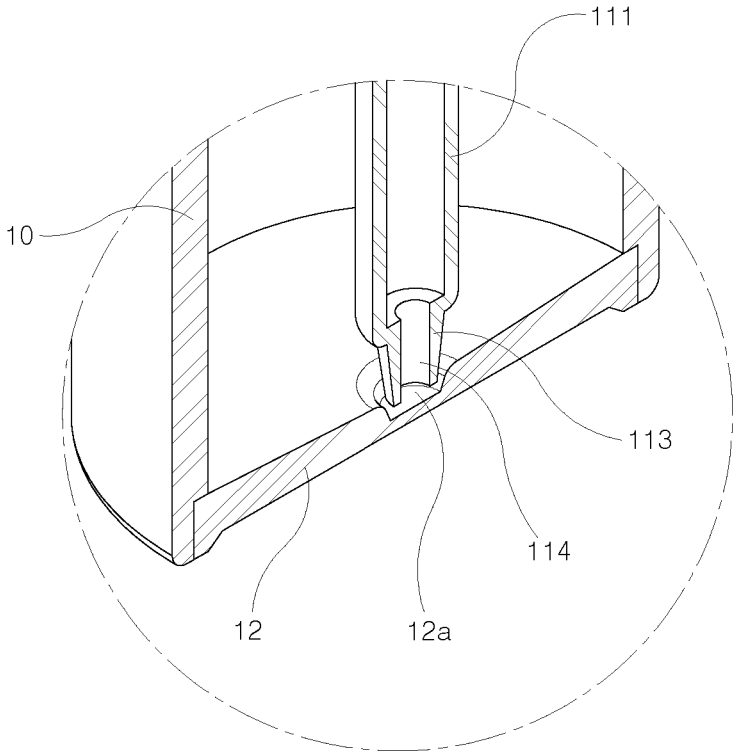
FIG. 13 shows an enlarged state of a portion B in FIG. 11.

FIG. 10 shows a completely extracted state of the spout tube. FIG. 11 is a broken perspective view corresponding to FIG. 1. FIG. 12 shows an enlarged state of a portion A in FIG. 11. FIG. 13 shows an enlarged state of a portion B in FIG. 11.

Figure 14A:
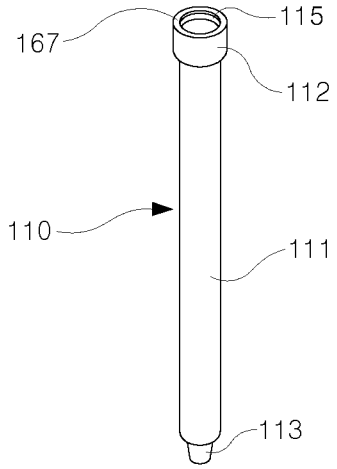
FIGS. 14A-14B show the spout tube according to the embodiment of the present invention.
Figure 14B:
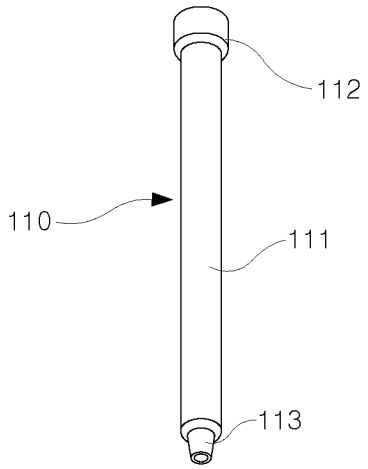
Figure 15A:
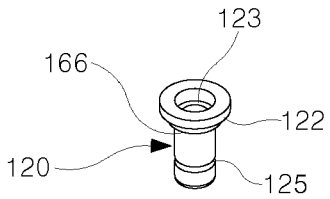
FIGS. 15A-15B show a connecting tube according to the embodiment of the present invention.
Figure 15B:
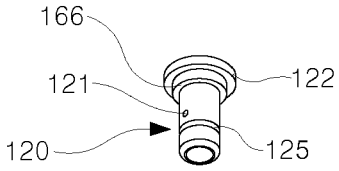
Figure 16A:
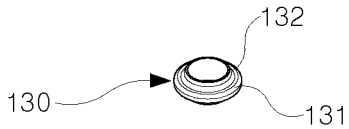
FIGS. 16A-16B show the communication hole opening/closing ring according to the embodiment of the present invention.
Figure 16B:
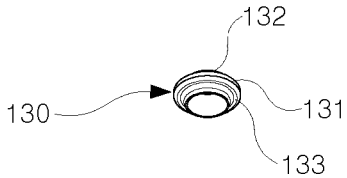
Figure 17A:
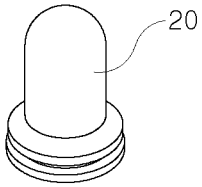
FIGS. 17A-17B show a pusher according to the embodiment of the present invention.
Figure 17B:
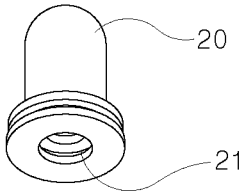
Figure 18A:
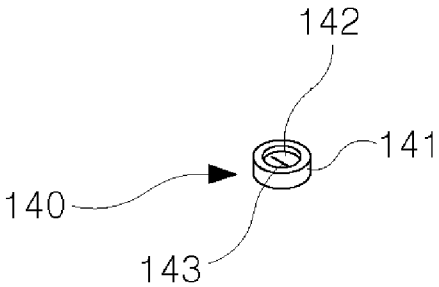
FIGS. 18A-18B show a valve according to the embodiment of the present invention.
Figure 18B:
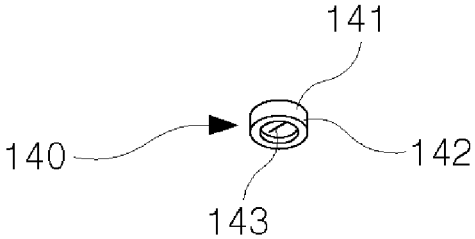
Figure 19A:
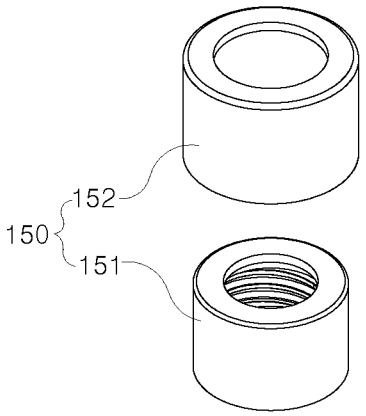
FIGS. 19A-19B show a cap according to the embodiment of the present invention.
Figure 19B:
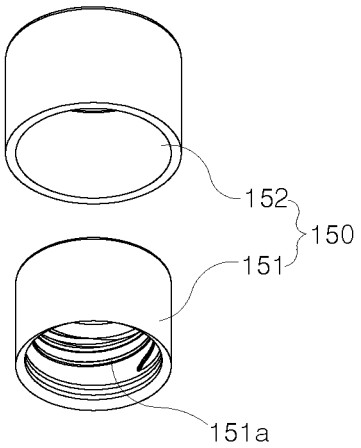
Figure 20A:
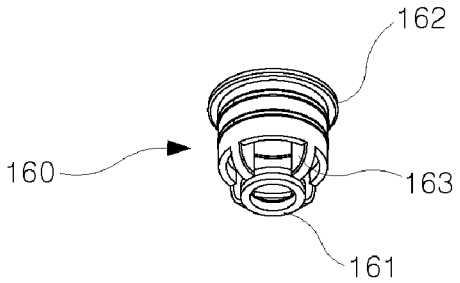
FIGS. 20A-20B show a wiper according to the embodiment of the present invention.
Figure 20B:
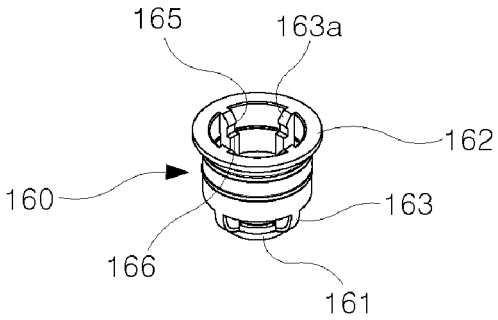

FIGS. 14A-14B show the spout tube according to the embodiment of the present invention. FIGS. 15A-15B show a connecting tube according to the embodiment of the present invention. FIGS. 16A-16B show the communication hole opening/closing ring according to the embodiment of the present invention. FIGS. 17A-17B show a pusher according to the embodiment of the present invention. FIGS. 18A-18B show a valve according to the embodiment of the present invention. FIGS. 19A-19B show a cap according to the embodiment of the present invention. FIGS. 20A-20B show a wiper according to the embodiment of the present invention.

As shown in the above drawings, the automatically-chargeable spout type cosmetics container according to the embodiment of the present invention designated by reference numeral "100" is characterized by a configuration including: a container body 10 configured to receive a cosmetics liquid therein; a spout tube 110 configured to suck and discharge the cosmetics liquid of the container body 10; a connecting tube 120 provided, at an outer peripheral surface thereof, with a communication hole 121 communicating with the container body 10; a communication hole opening/closing ring 130 configured to selectively open or close the communication hole 121; a pusher 20 configured to discharge the cosmetics liquid charged in the spout tube 110; a valve 140 configured to prevent the cosmetics liquid of the spout tube 110 from being introduced into the pusher 20; and a wiper 160 configured to wiper a cosmetics liquid attached to an outer peripheral surface of the spout tube 110 and to enable the communication hole opening/closing ring 130 to open or close the communication hole 121 when the spout tube 110 is inserted or extracted.

Hereinafter, the constituent elements of the automatically-chargeable spout type cosmetics container according to the embodiment of the present invention will be described in more detail.

First, as shown in FIGS. 1 to 3, the container body 10 may be provided with a space configured to receive a cosmetics liquid therein, and may be formed, at an upper portion thereof, with an opening 11 referred to as a "neck". Male threads 11*a* may be formed at an outer periphery of the opening 11.

In addition, as shown in FIGS. 4 and 14A-14B, the spout tube 110 is installed to be inserted into or extracted from the container body 10 through the opening 11. The spout tube 110 is formed, at the lower end thereof, with a cosmetics liquid hole 114 in order to suck the cosmetics liquid of the container body 10 and to discharge the cosmetics liquid in an amount desired by the user.

The body 111 of the spout tube 110 has a circular tube shape, and is formed, at an upper end thereof, with a coupling 112 having a greater diameter than that of the body 111 while being formed, at a lower end thereof, with a nozzle 113 having the cosmetics liquid hole 114.

In addition, as shown in FIGS. 5 and 15A-15B, the connecting tube 120 is provided at an upper portion of the spout tube 110, and is provided, at the outer peripheral surface thereof, with the communication hole 121 communicating with the container body 10 such that the cosmetics liquid may be automatically charged (filled) in an interior of the spout tube 110 to a level equal to the level of the cosmetics liquid received in the container body 10. Connection between the connecting tube 120 and the spout tube 10 may be firmly achieved through coupling between a groove 125 and a protrusion 115.

A lower end of the connecting tube 120 may be coupled to an inside of the coupling 112 of the spout tube 11 in a forced fitting manner. A coupling protrusion 122, which is configured to be coupled to a coupling groove 21 of the pusher 20, may be formed at an upper end of the connecting tube 120.

A gap G (shown in FIG. 6) is formed between the outer peripheral surface of the connecting tube 120 and an inner peripheral surface of the wiper 160 by a spacer 163 shown in FIG. 6 and, as such, the communication hole 121 formed at the outer peripheral surface of the connecting tube 120 causes the interior of the spout tube 110 to communicate with the container body 10. Accordingly, the cosmetics liquid may be automatically charged (filled) in the interior of the spout tube 110 to a level equal to the level of the cosmetics liquid received in the container body 10.

In addition, referring to FIGS. 12 and 16A-16B, the communication hole opening/closing ring 130 is elastically installed at the outer peripheral surface of the connecting tube 120 such that the communication hole opening/closing ring 130 is vertically movable, in order to selectively open or close the communication hole 121 when the spout tube 110 is inserted into the container body 10 or is extracted from the container body 10.

As shown in FIGS. 4, 7, and 8, the communication hole opening/closing ring 130 is configured through inclusion of a body 131, an upper wing 132 formed at an upper portion of the body 131, to extend upwards, and a lower wing 133 formed at a lower portion of the body 131, to extend downwards. The communication hole opening/closing ring 130 may be made of a soft material such as rubber or the like. The upper wing 132 and the lower wing 133 are configured to bring the body 131 into elastic contact with a second stopper 165, which will be described later, when insertion or extraction of the spout tube 110 is carried out.

In addition, the pusher 20 is fixedly installed at an upper portion of the connecting tube 120, and provides air to an interior of the spout tube 110, for discharge of the cosmetics liquid charged in the spout tube 110.

That is, when the pusher 20 is pressed, air present in the pusher 20 is introduced into the spout tube 110. Accordingly, the cosmetics liquid charged in the spout tube 110 is discharged through the cosmetics liquid hole 114. When the pusher 20 is restored, air is again introduced into the pusher 20 through the cosmetics liquid hole 114 in an amount corresponding to the discharged amount of the cosmetics liquid (cf. FIGS. 21A-21B).

In addition, the valve 140 may be fixedly installed at an upper jaw 123 of the connecting tube 120. Accordingly, when the pusher 20 is pressed or restored, the valve 140 allows air present in the pusher 20 to be introduced into the spout tube 110, but prevents the cosmetics liquid in the spout tube 110 from being introduced (backward flow) into the pusher 20.

That is, when a cosmetics liquid flow or an air flow is generated in accordance with a pressure difference generated during depression or restoration of the pusher 20, air present in the pusher 20 is allowed to be introduced into the spout tube 110 or ambient air is allowed to be introduced into the pusher 20 by the valve 140, whereas it may be possible to effectively prevent the cosmetics liquid of the spout tube 110 from being introduced (backward flow) into the pusher 20 by the valve 140.

Accordingly, deformation and hardening of the pusher 20, which is made of a rubber material, may be effectively prevented through prevention of the cosmetics liquid from contacting the pusher 20 as described above.

Hereinafter, the structure of the valve 140 will be described. A flange 141 is formed at an outer periphery of the valve 140 such that the valve 140 is fixedly installed at the upper jaw 123 of the connecting tube 120. A flexible membrane 142 having a slit 143 is formed at an inner periphery of the flange 141.

The slit 143 may be opened only by a pressure difference generated when the pusher 20 is pressed or restored. The opening degree of the slit 143 is set to be limited to a predetermined degree.

That is, when a cosmetics liquid flow or an air flow is generated due to the pressure difference generated during depression or restoration of the pusher 20, the slit 143 of the valve 140 is opened, thereby allowing air present in the pusher 20 to be introduced into the spout tube 110 or allowing ambient air to be introduced into the pusher 20, but preventing the cosmetics liquid of the spout tube 110 from being introduced (backward flow) into the pusher 20. Accordingly, the cosmetics liquid is prevented from contacting the pusher 20 and, as such, deformation and hardening of the pusher 20 is prevented. Thus, degradation in the function of the pusher 20 may be prevented.

In addition, as shown in FIGS. 7 and 19A-19B, the cap 150 may be separably fastened to the opening 11, to be opened or closed, and may be fixedly installed at a lower portion of the pusher 20.

The cap 150 may be constituted by an inner cap 151 having female threads 151*a* at an inner periphery thereof and an outer cap 152 surrounding the inner cap 151. The inner cap 151 and the outer cap 152 may be coupled to each other in a forced fitting manner.

In addition, as shown in FIGS. 7 and 20A-20B, the wiper 160 may be installed at an inner periphery of the opening 11 in order to wipe a cosmetics liquid attached to an outer periphery surface of the spout tube 110 when the cap 150 is opened to extract the spout tube 110.

A wiping portion 161 may be formed at a lower end of the wiper 160 in order to wipe a cosmetics liquid attached to the outer periphery surface of the spout tube 110. A seating flange 162 may be formed at an upper end of the wiper 160. The seating flange 162 may closely contact the opening 11.

The spacer 163 may be formed at the inner peripheral surface of the wiper 160 in order to maintain opening of the communication hole 121 when the cap 150 is closed to insert the spout tube 110.

As described above, a gap is formed between the outer peripheral surface of the connecting tube 120 and the inner peripheral surface of the wiper 160 by the spacer 163 and, as such, the communication hole 121 formed at the outer peripheral surface of the connecting tube 120 causes the interior of the spout tube 110 to communicate with the container body 10. Accordingly, the cosmetics liquid may be automatically charged in the interior of the spout tube 110 to a level equal to the level of the cosmetics liquid received in the container body 10.

A first stopper 164 may be formed at a lower portion of an upper end of the spacer 163. The first stopper 164 functions to prevent downward movement of the communication hole opening/closing ring 130 when the spout tube 110 is inserted, thereby causing the communication hole opening/closing ring 130 to open the communication hole 121. The second stopper 165 may be formed at an upper portion of the upper end of the spacer 163. The second stopper 165 functions to prevent upward movement of the communication hole opening/closing ring 130 when the spout tube 110 is extracted, thereby causing the communication hole opening/closing ring 130 to close the communication hole 121.

As is generally known, when it is desired to automatically charge (fill) the cosmetics liquid in the spout tube 110, the cap 150 is closed such that the spout tube 110 is inserted into the container body 10, whereas, when it is desired to discharge the cosmetics liquid charged in the spout tube 110, the cap 150 is opened such that the spout tube 110 is extracted from the container body 10.

In the embodiment of the present invention, when the spout tube 110 is inserted, the first stopper 164 prevents downward movement of the communication hole opening/closing ring 130, thereby causing the communication hole opening/closing ring 130 to open the communication hole 121. Accordingly, the internal pressure of the container body 10 and the internal pressure of the spout tube 110 become equal and, as such, the cosmetics liquid is automatically charged (filled) in the interior of the spout tube 110 to a level equal to the level of the cosmetics liquid received in the container body 10.

On the other hand, when the spout tube 110 is extracted, the second stopper 165 prevents upward movement of the communication hole opening/closing ring 130, thereby causing the communication hole opening/closing ring 130 to close the communication hole 121. Accordingly, when the user presses the pusher 20, to discharge the cosmetics liquid charged in the spout tube 110, air present in the pusher 20 is supplied to the interior of the spout tube 110 through the slit 143 of the valve 140 and, as such, the cosmetics liquid of the spout tube 110 is discharged.

That is, as shown in FIGS. 8 and 9, when the spout tube 110 is extracted, the second stopper 165 prevents upward movement of the communication opening/closing ring 130, thereby causing the communication hole opening/closing ring 130 to close the communication hole 121. In connection with this, a first step 166 may be formed at an upper end of the spout tube 110 in order to set a position of the communication hole opening/closing ring 130 after the communication hole opening/closing ring 130 closes the communication hole 121. In addition, inclined surfaces (slant surfaces) may be formed at an outer peripheral surface of the communication hole opening/closing ring 130 and an inner peripheral surface of the second stopper 165, respectively, in order to enable the communication hole opening/closing ring 130 to be separated from the second stopper 165 after a position of the communication hole opening/closing ring 130 is set by the first step 166.

As shown in FIGS. 11 and 12, when the spout tube 110 is inserted, the first stopper 164 prevents downward movement of the communication opening/closing ring 130, thereby causing the communication hole opening/closing ring 130 to open the communication hole 121. In connection with this, a second step 167 may be formed at the upper end of the connecting tube 120 in order to set a position of the communication hole opening/closing ring 130 after the communication hole opening/closing ring 130 opens the communication hole 121.

As shown in FIG. 12, the communication hole opening/closing ring 130 may be configured through inclusion of the body 131, which is disposed between the first stopper 164 and the second stopper 165 when the spout tube 110 is inserted, the upper wing 132, which is formed at the upper portion of the body 131, to extend upwards, and is brought into contact with the second step 167 when the spout tube 110 is inserted, and the lower wing 133, which is formed at the lower portion of the body 131, to extend downwards, and is brought into contact with the first step 166 when the spout tube 110 is extracted.

As shown in FIGS. 3, 6, and 20, the spacer 163 may be formed in a number of at least two at the inner peripheral surface of the wiper 160 such that the at least two spacers 163 are spaced apart from one another by a predetermined distance. A guide 163*a* (shown in FIGS. 20A-20B) may be inclinedly formed at the upper end of the spacer 163 in order to guide insertion (downward movement) of the communication hole opening/closing ring 130 when the spout tube 110 is inserted. That is, the guide 163*a* is formed to be inclined toward a center of the wiper 160 such that the communication hole opening/closing ring 130 is stably seated on the first stopper 164.

In addition, as shown in FIG. 13, the container body 10 may be configured such that a bottom plate 12 is provided at a lower end of the container body 10, a cosmetics liquid residual collection groove 12*a* is formed at a central portion of an upper surface of the bottom plate 12, and the upper surface of the bottom plate 12 is formed to be inclined toward the cosmetics liquid residual collection groove 12*a* such that the lower end of the spout tube 110 is inserted into the cosmetics liquid residual collection groove 12*a*. That is, the container body 10 may be configured such that the nozzle 113 having the cosmetics liquid hole 114 may be inserted into the cosmetics liquid residual collection groove 12*a*.

As described above, conventional cosmetics containers are manufactured in a blow molding manner. In such a conventional cosmetics container, the bottom surface of the cosmetics container protrudes upwards at a central portion thereof due to characteristics of container manufacture using blow molding, and is manufactured to be spaced apart from a lower end of a spout tube by 3 mm or more, taking tolerances into consideration, in order to prevent the lower end of the spout tube from contacting the bottom surface of the cosmetics container. For this reason, even when the cosmetics container is completely used, the cosmetics liquid still remains in a considerable amount and, as such, this is uneconomical. Furthermore, when the residual cosmetics liquid is disposed of without any treatment, there may be a problem of environmental pollution.

In the embodiment of the present invention, the upper surface of the bottom plate 12 has a structure inclined toward a center thereof (so called a "funnel structure") and, as such, a residual cosmetics liquid is collected in the cosmetics liquid residual collection groove 12*a*. Accordingly, the amount of the cosmetics liquid remaining in the container body 10 may be minimized by virtue of the nozzle 113 inserted into the cosmetics liquid residual collection groove 12*a*.

The bottom plate 12 may be constituted by a part separate from the container body 10, and may be manufactured in an insert injection molding manner. Insert injection molding is a method in which injection molding is performed under the condition that an insert is placed within a mold cavity before injection molding.

The insert may be made of a plastic different from an injection molding material. A most remarkable advantage of the insert injection molding is that it may be possible to achieve an enhancement in plastic performance, to reduce assembly and labor costs, and to enhance design flexibility and reliability of parts.

Figure 21A:
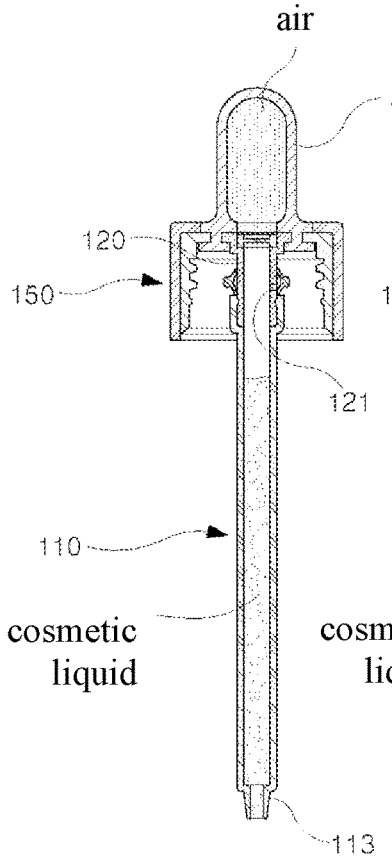
FIGS. 21A-21B are a view showing a procedure of discharging a cosmetics liquid in the automatically-chargeable spout type cosmetics container according to the embodiment of the present invention.
Figure 21B:
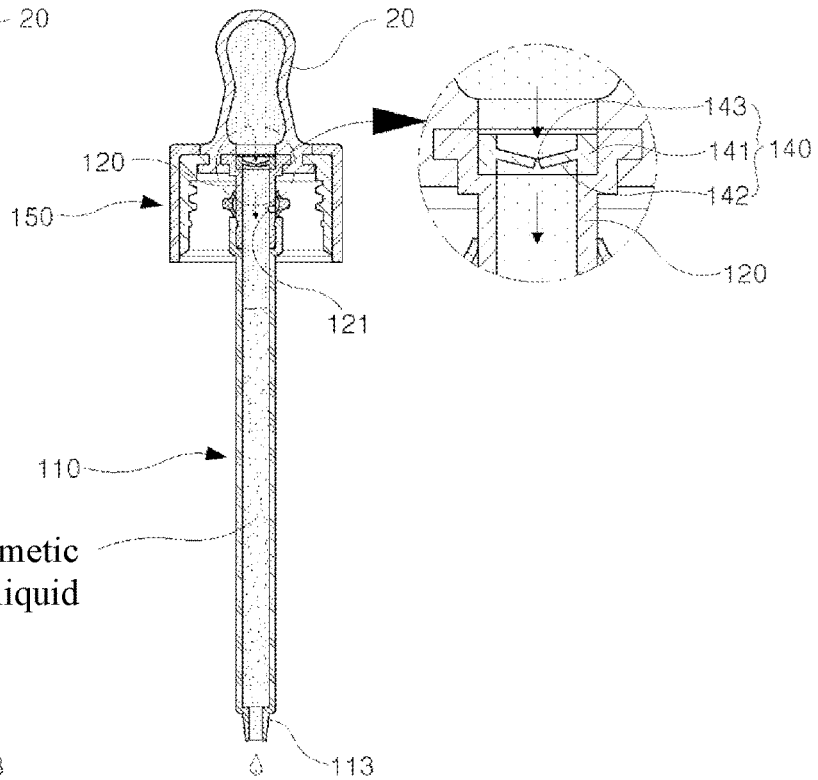

FIGS. 21A-21B are a view explaining discharge of the cosmetics liquid in the automatically-chargeable spout type cosmetics container according to the embodiment of the present invention. Referring to FIGS. 21A-21B, in the automatically-chargeable spout type cosmetics container according to the embodiment of the present invention, when the pusher 20 is pressed after the spout tube 110 is extracted from the container body 10, air present in the pusher 20 is introduced into the interior of the spout tube 110 through the valve 140 and, as such, the cosmetics liquid charged in the spout tube 110 is discharged through the cosmetics liquid hole 114. That is, the slit 143 of the valve 140 is opened by a pressure generated when the pusher 20 is pressed and, as such, air present in the pusher 20 is introduced into the interior of the spout tube 110 through the slit 143. At the same time, the cosmetics liquid charged in the spout tube 110 is discharged by the pressure of the air introduced into the interior of the spout tube 110.

As apparent from the above description, the present invention has the following effects.

First, when a cosmetics liquid flow or an air flow is generated in accordance with a pressure difference generated during depression or restoration of the pusher, air present in the pusher is allowed to be introduced into the spout tube or ambient air is allowed to be introduced into the pusher by the valve, whereas it may be possible to effectively prevent the cosmetics liquid of the spout tube from being introduced into the pusher by the valve.

Second, a gap is formed between the outer peripheral surface of the connecting tube and the inner peripheral surface of the wiper by the spacer formed at the inner peripheral surface of the wiper and, as such, the communication hole formed at the outer peripheral surface of the connecting tube causes the interior of the spout tube to communicate with the container body. Accordingly, the cosmetics liquid may be automatically charged in the interior of the spout tube to a level equal to the level of the cosmetics liquid received in the container body.

Third, the communication hole opening/closing ring is elastically installed at the outer peripheral surface of the connecting tube such that the communication hole opening/closing ring is vertically movable, in order to selectively open or close the communication hole when the spout tube is inserted into the container body or is extracted from the container body. Accordingly, when the spout tube is extracted, the second stopper prevents upward movement of the communication opening/closing ring, thereby causing the communication hole opening/closing ring to close the communication hole. On the other hand, when the spout tube is inserted, the first stopper prevents downward movement of the communication opening/closing ring, thereby causing the communication hole opening/closing ring to open the communication hole. Thus, automatic charging and discharge of the cosmetics liquid may be easily achieved and, as such, there is an advantage of convenience in use.

Fourth, assemblability may be enhanced, and production costs may be reduced in that the overall configuration is simple, and automatic charging and discharge of the cosmetics liquid are easily achieved.

Fifth, the bottom plate is formed at the bottom of the container body in an insert molding manner, the cosmetics liquid residual collection groove is formed at the central portion of the upper surface of the bottom plate, and the upper surface of the bottom plate is configured to have an inclined structure. Accordingly, a cosmetics liquid residual is collected in the cosmetics liquid residual collection groove and, as such, the amount of the cosmetics liquid remaining in the container body may be minimized by virtue of the nozzle inserted into the cosmetics liquid residual collection groove.

Meanwhile, preferred embodiments of the present invention are disclosed in the specification and the drawings, and specific terms are used in connection therewith. However, these terms are only used to easily explain the technical contents of the present invention and to assist in understanding of the present invention in a general sense, without being construed as limiting the scope of the present invention. It is obvious to those skilled in the art to which the present invention pertains that, in addition to the embodiments disclosed herein, other variations based on the technical idea of the present invention may be implemented.

For example, although the connecting tube 120 in the embodiment of the present invention is constituted by a part separate from the spout tube 110 such that the connecting tube 120 is connected to the spout tube 110, the connecting tube 120 may be formed to be integrated with the spout tube 110.

Preferably, the wiper 160 is made of at least one of polyethylene, urethane rubber, natural rubber, an elastomer, nitrile-butadiene rubber (NBR), and silicone which have elasticity.

The present invention may be modified in various ways and may have various forms. However, it should be understood that the present invention is not limited to specific embodiments described in the above detailed description, but includes all modifications, equivalents and substitutes included within the spirit and technical scope of the present invention.

INDUSTRIAL APPLICABILITY

The present invention relating to an automatically-chargeable spout type cosmetics container capable of automatically charging a cosmetics liquid in an interior of a spout tube to a level equal to the level of the cosmetics liquid received in a container body is widely applicable to the field of automatically-chargeable spout type cosmetics containers.

The invention claimed is:

1. An automatically-chargeable spout type cosmetics container comprising:

a container body (10) configured to receive a cosmetics liquid therein and formed with an opening (11) at an upper portion thereof;

a spout tube (110) installed to be inserted into the container body (10) through the opening (11), the spout tube (110) being formed, at a lower end thereof, with a cosmetics liquid hole (114), to suck and discharge the cosmetics liquid of the container body (10);

a connecting tube (120) provided at an upper portion of the spout tube (110), the connecting tube (120) being provided, at an outer peripheral surface thereof, with a communication hole (121) communicating with the container body (10), to automatically charge the cosmetics liquid in an interior of the spout tube (110) to a level equal to a level of the cosmetics liquid received in the container body (10);

a communication hole opening/closing ring (130) elastically installed at the outer peripheral surface of the connecting tube (120) such that the communication hole opening/closing ring (130) is vertically movable, to selectively open or close the communication hole (121) when the spout tube (110) is inserted into the container body (10) or is extracted from the container body (10);

a pusher (20) fixedly installed at an upper portion of the connecting tube (120) and configured to provide air to the interior of the spout tube (110), to discharge the cosmetics liquid charged in the spout tube (110);

a valve (140) installed at the upper portion of the connecting tube (120), to allow air in the pusher (20) to be introduced into the spout tube (110) while preventing the cosmetics liquid in the spout tube (110) from being introduced into the pusher (20) when the pusher is pressed;

a cap (150) fixedly installed at a lower portion of the pusher (20) and fastened to the opening (11), to be opened and closed; and a wiper (160) installed at an inner periphery of the opening (11) to wipe a cosmetics liquid attached to an outer periphery surface of the spout tube (110), the wiper (160) comprising a spacer (163) formed at an inner peripheral surface of the wiper (160) and configured to maintain opening of the communication hole (121) when the cap (150) is closed to insert the spout tube (110), a first stopper (164) formed at a lower portion of an upper end of the spacer (163) and configured to prevent downward movement of the communication hole opening/closing ring (130) when the spout tube (110) is inserted, thereby causing the communication hole opening/closing ring (130) to open the communication hole (121), and a second stopper (165) formed at an upper portion of the upper end of the spacer (163) and configured to prevent upward movement of the communication hole opening/closing ring (130) when the spout tube (110) is extracted, thereby causing the communication hole opening/closing ring (130) to close the communication hole (121).

2. The automatically-chargeable spout type cosmetics container according to claim 1, wherein:

when the spout tube (110) is inserted, the first stopper (164) prevents downward movement of the communication opening/closing ring (130), thereby causing the communication hole opening/closing ring (130) to open the communication hole (121) such that the cosmetics liquid is automatically charged in the interior of the spout tube (110) to a level equal to a level of the cosmetics liquid received in the container body (10); and when the spout tube (110) is extracted, the second stopper (165) prevents upward movement of the communication hole opening/closing ring (130), thereby causing the communication hole opening/closing ring (130) to close the communication hole (121) such that, when the pusher (20) is pressed to discharge the cosmetics liquid charged in the spout tube (110), air present in the pusher (20) is supplied to the interior of the spout tube (110), to enable the cosmetics liquid of the spout tube (110) to be discharged.

3. The automatically-chargeable spout type cosmetics container according to claim 2, wherein a first step (166) is formed at an upper end of the spout tube (110), to set a position of the communication hole opening/closing ring (130) after the communication hole opening/closing ring (130) closes the communication hole (121) as the second stopper (165) prevents upward movement of the communication opening/closing ring (130) when the spout tube (110) is extracted, and inclined surfaces are formed at an outer peripheral surface of the communication hole opening/closing ring (130) and an inner peripheral surface of the second stopper (165), respectively, to enable the communication hole opening/closing ring (130) to be separated from the second stopper (165) after a position of the communication hole opening/closing ring (130) is set by the first step (166).

4. The automatically-chargeable spout type cosmetics container according to claim 3, wherein a second step (167) is formed at an upper end of the connecting tube (120), to set a position of the communication hole opening/closing ring (130) after the communication hole opening/closing ring (130) opens the communication hole (121) as the first stopper (164) prevents downward movement of the communication opening/closing ring (130) when the spout tube (110) is inserted.

5. The automatically-chargeable spout type cosmetics container according to claim 4, wherein the communication hole opening/closing ring (130) comprises:

a body (131) disposed between the first stopper (164) and the second stopper (165) when the spout tube (110) is inserted;

an upper wing (132) formed at an upper portion of the body (131), to extend upwards, the upper wing (132) being brought into contact with the second step (167) when the spout tube (110) is inserted; and a lower wing (133) formed at a lower portion of the body (131), to extend downwards, the lower wing (133) being brought into contact with the first step (166) when the spout tube (110) is extracted.

6. The automatically-chargeable spout type cosmetics container according to claim 1, wherein the spacer (163) is formed in a number of at least two at the inner peripheral surface of the wiper (160) such that the at least two spacers (163) are spaced apart from one another by a predetermined distance, and a guide (163*a*) is inclinedly formed at the upper end of the spacer (163), to guide downward movement of the communication hole opening/closing ring (130) when the spout tube (110) is inserted.

7. The automatically-chargeable spout type cosmetics container according to claim 1, wherein:

the container body (10) is provided with a bottom plate (12) at a lower end thereof;

a cosmetics liquid residual collection groove (12*a*) is formed at a central portion of an upper surface of the bottom plate (12);

the upper surface of the bottom plate (12) is formed to be inclined toward the cosmetics liquid residual collection groove (12*a*); and the lower end of the spout tube (110) is inserted into the cosmetics liquid residual collection groove (12*a*).

8. The automatically-chargeable spout type cosmetics container according to claim 7, wherein the bottom plate (12) is manufactured as a part separate from the container body (10).

9. The automatically-chargeable spout type cosmetics container according to claim 8, wherein the bottom plate (12) is manufactured in an insert injection molding manner.

10. The automatically-chargeable spout type cosmetics container according to claim 1, wherein:

the wiper (160) is formed, at the inner peripheral surface thereof, with a spacer (163) configured to maintain opening of the communication hole (121) when the cap (150) is closed to insert the spout tube (110);

a first stopper (164) is formed at the lower portion of the upper end of the spacer (163) and is configured to prevent downward movement of the communication hole opening/closing ring (130) when the spout tube (110) is inserted, thereby causing the communication hole opening/closing ring (130) to open the communication hole (121); and a second stopper (165) is formed at the upper portion of the upper end of the spacer (163) and is configured to prevent upward movement of the communication hole opening/closing ring (130) when the spout tube (110) is extracted, thereby causing the communication hole opening/closing ring (130) to close the communication hole (121).

* * * * *